US008973674B2

(12) United States Patent
Leuchtenberg

(10) Patent No.: US 8,973,674 B2
(45) Date of Patent: Mar. 10, 2015

(54) DRILLING SYSTEM AND METHOD OF OPERATING A DRILLING SYSTEM

(75) Inventor: Christian Leuchtenberg, Brussels (BE)

(73) Assignee: Managed Pressure Operations PTE Ltd., Singapore (SG)

( * ) Notice: Subject to any disclaimer, the term of this patent is extended or adjusted under 35 U.S.C. 154(b) by 235 days.

(21) Appl. No.: 13/580,844

(22) PCT Filed: Feb. 23, 2011

(86) PCT No.: PCT/EP2011/052687

§ 371 (c)(1),
(2), (4) Date: Oct. 4, 2012

(87) PCT Pub. No.: WO2011/104279

PCT Pub. Date: Sep. 1, 2011

(65) Prior Publication Data

US 2013/0014991 A1 Jan. 17, 2013

(30) Foreign Application Priority Data

Feb. 24, 2010 (GB) ..... 1003096.3

(51) Int. Cl.
*E21B 17/01* (2006.01)
*E21B 21/08* (2006.01)
(Continued)

(52) U.S. Cl.
CPC ..... *E21B 19/006* (2013.01); *E21B 21/08* (2013.01); *E21B 33/085* (2013.01); *E21B 2021/006* (2013.01)
USPC ..... 175/10; 175/48; 166/358; 166/367

(58) Field of Classification Search
CPC ..... E21B 7/12; E21B 17/01; E21B 19/006; E21B 21/08
USPC ..... 175/5, 10, 40, 48; 166/355, 358, 367; 405/224.2, 224.4
See application file for complete search history.

(56) References Cited

U.S. PATENT DOCUMENTS 3,313,345 A * 4/1967 Fischer ..... 166/355
3,675,713 A 7/1972 Watkins
(Continued)

FOREIGN PATENT DOCUMENTS

CN 1643233 A 7/2005
GB 2427217 12/2006
(Continued)

OTHER PUBLICATIONS

PCT Search Report (PCT/EP2011/052687), dated Mar. 5, 2012.
(Continued)

*Primary Examiner* — Matthew Buck
(74) *Attorney, Agent, or Firm* — Bracewell & Giuliani LLP

(57) ABSTRACT

A drilling system (10) including a drill string (13) which extends from a floating drilling rig to a well bore, and a tubular riser (12) which surrounds at least part of the portion of the drill string (13) between the well bore and drilling rig, the riser (12) having a telescopic joint (20) between a first tubular portion and a second tubular portion of the riser, the first tubular portion extending down to a well head at the top of the well bore and the second tubular portion extending up towards the drilling rig, the telescopic joint (20) comprising an inner tube part (20*b*) which is mounted within an outer tube part (20*a*), the drilling system (10) further including a riser closure device (26) which is mounted in the second tubular portion of the riser (12) and which is operable to provide a substantially fluid tight seal between the riser (12) and the drill string (13) whilst permitting the drill string (13) to rotate relative to the riser (12).

16 Claims, 2 Drawing Sheets

Figure 1:
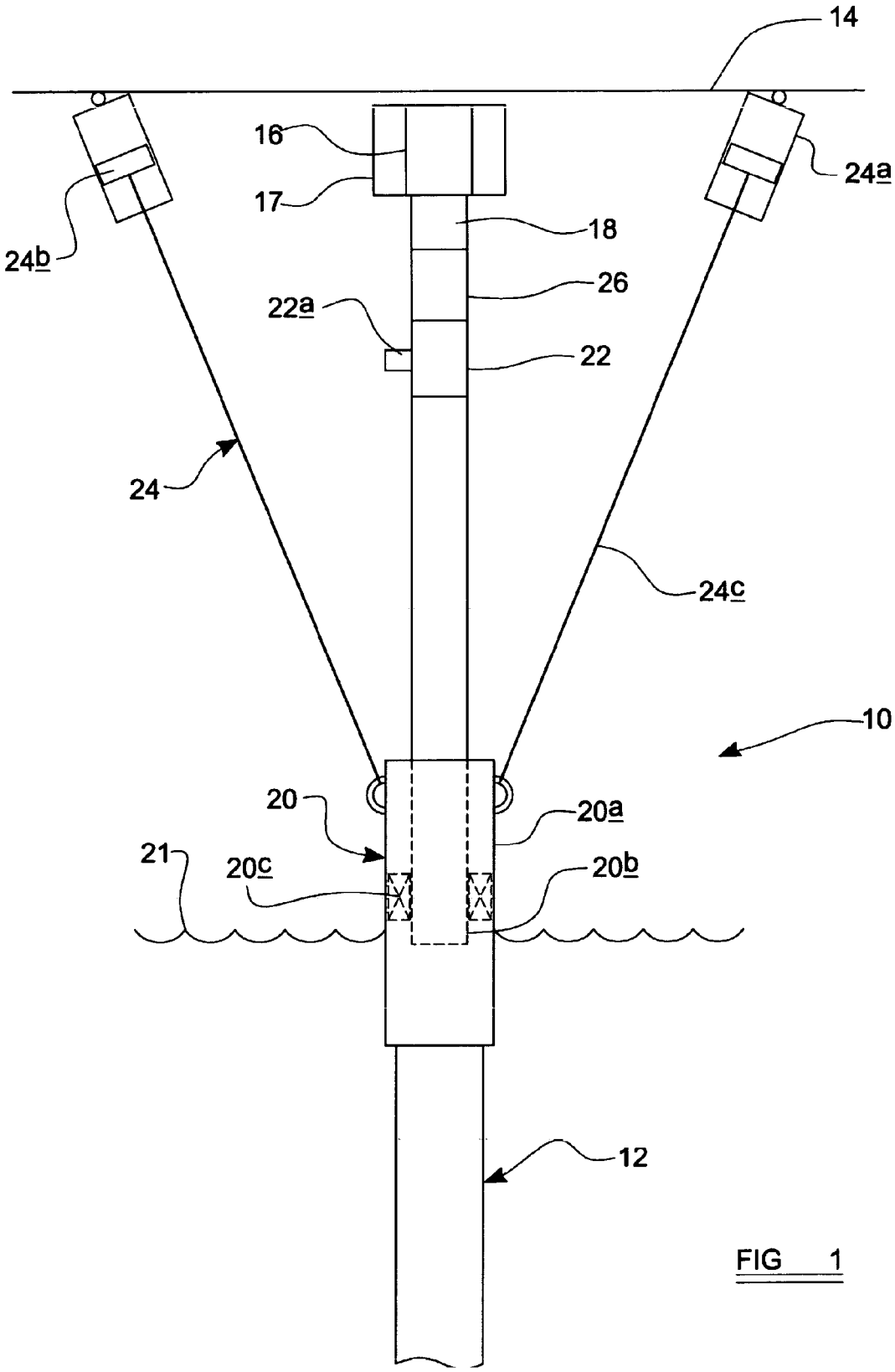

(51) Int. Cl.

| | |
|---|---|
| ***E21B 19/00*** | (2006.01) |
| ***E21B 33/08*** | (2006.01) |
| *E21B 21/00* | (2006.01) |

(56) References Cited

U.S. PATENT DOCUMENTS

| | | | | | |
|---|---|---|---|---|---|
| 3,695,633 | A | | 10/1972 | Hanes | |
| 3,910,110 | A | * | 10/1975 | Jefferies et al. | 73/152.21 |
| 3,976,148 | A | * | 8/1976 | Maus et al. | 175/7 |
| 4,282,939 | A | * | 8/1981 | Maus et al. | 175/7 |
| 4,411,434 | A | | 10/1983 | Lewis | |
| 4,440,239 | A | * | 4/1984 | Evans | 175/5 |
| 4,527,425 | A | * | 7/1985 | Stockton | 73/152.21 |
| 4,610,161 | A | * | 9/1986 | Gehrig et al. | 73/152.21 |
| 4,626,135 | A | | 12/1986 | Roche | |
| 5,168,932 | A | * | 12/1992 | Worrall et al. | 166/336 |
| 5,205,165 | A | * | 4/1993 | Jardine et al. | 73/152.21 |
| 6,263,982 | B1 | | 7/2001 | Hannegan et al. | |
| 2002/0074123 | A1 | | 6/2002 | Regan | |
| 2008/0105434 | A1 | * | 5/2008 | Orbell et al. | 166/356 |
| 2008/0210471 | A1 | * | 9/2008 | Bailey et al. | 175/48 |
| 2009/0139724 | A1 | | 6/2009 | Gray et al. | |

FOREIGN PATENT DOCUMENTS

| | | | |
|---|---|---|---|
| GB | 2443561 | A | 5/2008 |
| WO | 2007047800 | A2 | 4/2007 |

OTHER PUBLICATIONS

GB Search Report (GB1003096.3), dated Apr. 8, 2010.

* cited by examiner

DRILLING SYSTEM AND METHOD OF OPERATING A DRILLING SYSTEM

DESCRIPTION OF INVENTION

The present invention relates to a drilling system and method of operating a drilling system, particularly to a drilling system for offshore drilling including a riser, which permits fluid in the riser to be pressurised.

During drilling of a subsea wellbore, a riser is provided to return the drilling fluid (mud), cuttings and any other solids or fluids from the wellbore to the surface. The drill string extends down the centre of the riser, and the returning drilling fluid, cuttings etc flow along the annular space in the riser around the drill string (the riser annulus).

When drilling of the wellbore is carried out using a floating rig such as a drill ship, a semi-submersible, floating drilling or production platform, it is known to provide the riser with a slip joint which allows the riser to lengthen and shorten as the rig moves up and down as the sea level rises and falls with the tides and the waves. Such a slip joint is, for example, described in U.S. Pat. No. 4,626,135, and comprises an outer tube section which is connected to the wellhead, and an inner tube section which sits within the outer tube section and which is connected to the rig floor. Seals are provided between the outer and inner tube sections, and these substantially prevent leakage of fluid from the riser whilst allowing the inner tube section to slide relative to the outer tube section.

The riser assembly shown in U.S. Pat. No. 4,626,135 is also provided with a diverter which has an outlet port connecting a diverter line to the riser. The diverter may be operated, for example, in the event that a kick, i.e. fluid from the formation being drilled, enters the riser, to divert the unwanted hydrocarbons from the riser to the diverter line. During this operation of the diverter, drilling is stopped and a sealing element moves into sealing engagement with the drill pipe so as to close the upward fluid flow path of the riser annulus. Fluid pressure in the riser annulus is then increased by pumping mud into the riser annulus either directly via a kill line or indirectly via the drill string and well bore. The diverter cannot be operated to contain fluid pressure in the riser annulus whilst the drill string is rotating, however.

Drilling methods, such as managed pressure drilling or mud cap drilling, which involve the pressurisation of fluid in the wellbore annulus are becoming increasingly important, and these require the ability to contain fluid pressure in the riser annulus during drilling. One system for providing pressurised riser assembly is disclosed in US 2008/0105434. In this system, a universal riser section (OURS) is placed in the riser below the slip joint. The OURS includes, amongst other things, at least one rotating control device (RCD), together with all the usual connections and attachments required to operate the RCD.

According to a first aspect of the invention we provide a drilling system including a drill string which extends from a floating drilling rig to a well bore, and a tubular riser which surrounds at least part of the portion of the drill string between the well bore and drilling rig, the riser having a telescopic joint between a first tubular portion and a second tubular portion, the first tubular portion extending down to a well head at the top of the well bore and the second tubular portion extending up towards the drilling rig, the telescopic joint comprising an inner tube part which is mounted within an outer tube part, the drilling system further including a riser closure device which is mounted in the second portion of the riser and which is operable to provide a substantially fluid tight seal between the riser and the drill string whilst permitting the drill string to rotate relative to the riser.

By virtue of locating the riser closure device above the telescopic joint, installation and maintenance of the well control system is considerably simplified.

The riser closure device may be a rotating control device.

Advantageously, the riser has a main bore along which the drill string extends, and a side bore which extends from the main bore of the second portion of the riser between the telescopic joint and the riser closure device to the exterior of the riser. In this case, preferably the side bore is connected to a fluid flow line which extends from the side bore to a fluid reservoir, the fluid flow line being part of a flow control system.

The drilling system preferably further includes a flow control device, such as a valve or choke, which is provided in the fluid flow line and which is operable to restrict the flow of fluid along the fluid flow line to a variable degree. The flow control device is preferably controlled using an electronic control unit. The drilling system preferably further includes a pressure sensor which transmits an electrical signal indicative of the fluid pressure in the fluid flow line to the electronic control unit.

The drilling system may also include a damper system which comprises a cylinder which is divided into first and second substantially fluid tight chambers by means of a movable divider such as a diaphragm or piston, the first chamber being connected to the fluid flow line and the second chamber being connected to a pressurised gas reservoir. The damper system preferably further includes a pressure regulator device which is operable to control the pressure of gas in the second chamber. Preferably the pressure regulator device is controlled using the electronic control unit.

Advantageously the drilling system includes a displacement meter which provides a displacement signal indicative of the displacement of the first portion of the riser relative to the second portion of the riser. The displacement meter may be in communication with the electronic control unit so that it can transmit the displacement signal to the electronic control unit.

The drilling system may include a flow meter which is located in the fluid flow line, preferably between the side bore and the flow control device, the flow meter providing a flow signal indicative of the rate of fluid flow along the fluid flow line. The flow meter may be in communication with the electronic control unit so that it can transmit the flow signal to the electronic control unit.

Preferably the telescopic joint includes one or more seals which extend between the inner tube part and the outer tube part of the telescopic joint so as to provide a substantially fluid tight seal between the inner tube part and the outer tube part whilst permitting the inner tube part and outer tube part to slide relative to one another. The outer tube portion of the telescopic joint may be provided on the first portion of the riser, and the inner tube portion of the telescopic joint provided on the second portion of the riser.

The riser preferably further includes an angular displacement joint which is located in the second portion of the riser between the riser closure device and the drilling rig and which allows angular movement of the riser relative to the drilling rig.

According to a second aspect of the invention we provide a method of operating a drilling system according to claim 1 wherein the riser has a main bore along which the drill string extends, and a side bore which extends from the main bore of the second portion of the riser between the telescopic joint and the riser closure device to the exterior of the riser, the side bore being connected to a fluid flow line which extends from the side bore to a fluid reservoir, the fluid flow line being part of a flow control system which includes a flow control device, such as a valve or choke, which is provided in the fluid flow line and which is operable to restrict the flow of fluid along the fluid flow line to a variable degree, the flow control system further including a damper system which comprises a vessel (or chamber) which is divided into first and second substantially fluid tight chambers by means of a movable divider such as a diaphragm or piston, the first chamber being connected to the fluid flow line and the second chamber being connected to a pressurised gas reservoir, and a pressure regulator device which is electrically operable to control the pressure of gas in the second chamber, the method including the steps of controlling operation of both the flow control device and the pressure regulator to maintain a substantially constant fluid pressure in the fluid flow line.

According to a third aspect of the invention we provide a method of operating a drilling system according to claim 1 wherein the riser has a main bore along which the drill string extends, and a side bore which extends from the main bore of the second portion of the riser between the telescopic joint and the riser closure device to the exterior of the riser, the side bore being connected to a fluid flow line which extends from the side bore to a fluid reservoir, the fluid flow line being part of a flow control system, the flow control system including a flow meter which is located in the fluid flow line, preferably between the side bore and the flow control device, the flow meter providing a flow signal indicative of the rate of fluid flow along the fluid flow line ($Q_{out}$), the well control system further including a displacement meter which provides a displacement signal indicative of the displacement of the first portion of the riser relative to the second portion of the riser, wherein the method includes the steps of using the displacement signal to calculate a change in volume (δV) of fluid in the riser over a particular period of time (δT), and using the flow signal and the calculated change in volume of fluid in the riser to produce an adjusted out flow rate, comparing the adjusted flow rate with the rate of flow of drilling fluid into the drill string (the in flow rate), and if the adjusted out flow rate differs from the in flow rate by more than a first predetermined amount raise an alarm signal to alert an operator of this, if the adjusted out flow rate exceeds the in flow rate by more than a second pre-determined amount, operating the well control system to carry out a kick control procedure, and if the adjusted out flow rate is less than the in flow rate by more than a third pre-determined amount, operating the well control system to carry out an in flow control procedure.

Preferably δV is calculated using the formula $$\delta V=\delta D\cdot(A_{SJ}-A_{DS}),$$

where δD is the change in displacement of the first portion of the riser relative to the second over the period of time, $A_{SJ}$ is the internal cross-sectional area of the inner tube section of the telescopic joint, and $A_{DS}$ is the external cross-sectional area of the drill string.

Preferably the adjusted out flow rate ($Q_{out.adj}$) is calculated using the formula volumetric:

$$Q_{out.adj}=Q_{out}+\delta V/\delta T$$

where $Q_{out}$ is the measured volumetric out flow rate.

According to a fourth aspect of the invention we provide a method of operating a drilling system according to claim 1, wherein the riser has a main bore along which the drill string extends, and a side bore which extends from the main bore of the second portion of the riser between the telescopic joint and the riser closure device to the exterior of the riser, the side bore being connected to a fluid flow line which extends from the side bore to a fluid reservoir, the fluid flow line being part of a flow control system which includes a flow control device, such as a valve or choke, which is provided in the fluid flow line and which is operable to restrict the flow of fluid along the fluid flow line to a variable degree, the well control system further including a displacement meter which provides a displacement signal indicative of the displacement of the first portion of the riser relative to the second portion of the riser, wherein the method includes the steps of using the displacement signal to calculate a change in volume of fluid in the riser over a particular period of time (δV), and operating the flow control device to decrease the fluid pressure in the fluid flow line if there is an decrease in the riser volume or to increase the fluid pressure in the fluid flow line if there is an increase in the riser volume.

Figure 2:
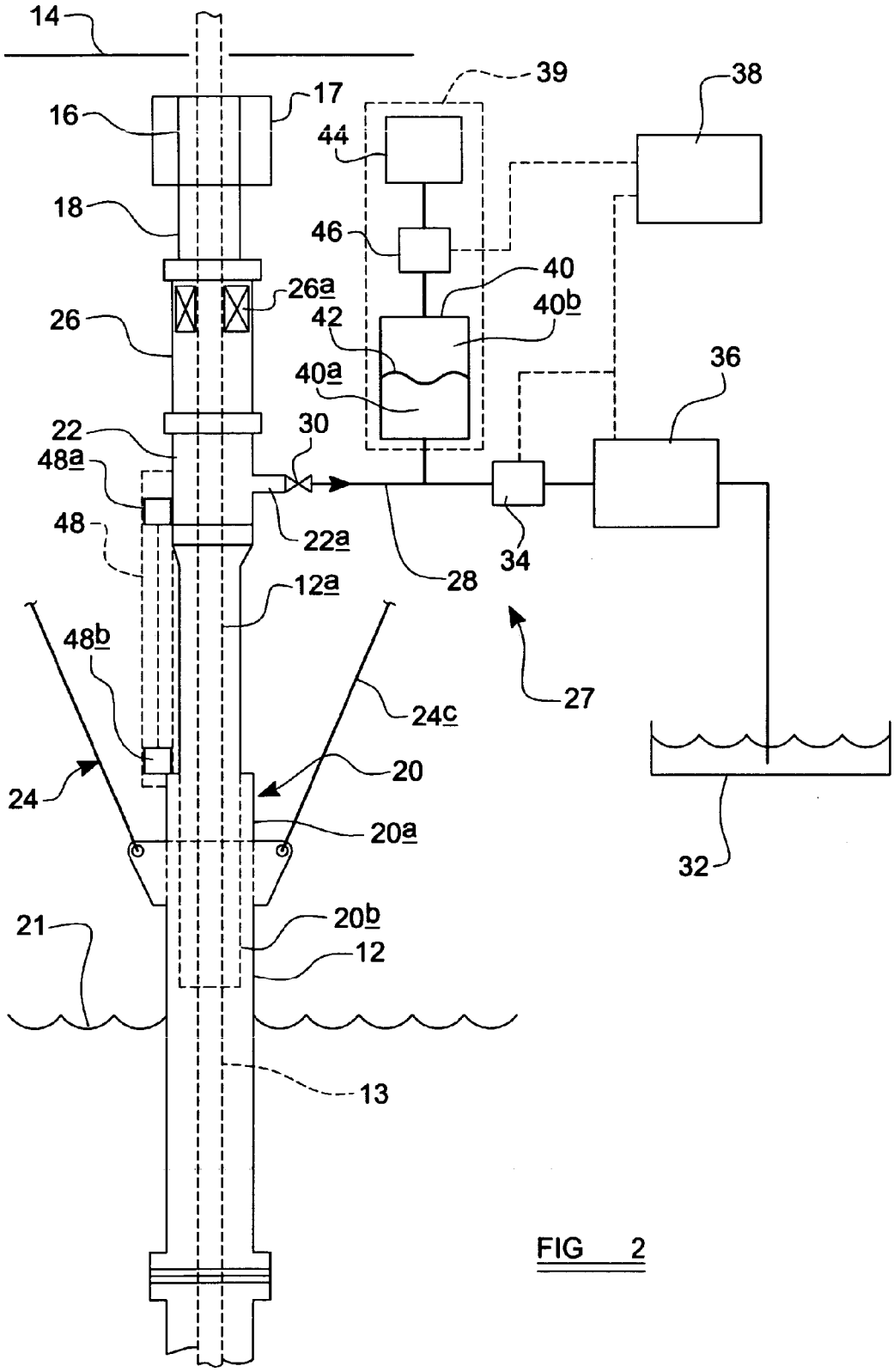

One embodiment of the invention will now be described, by way of example only, with reference to the following drawings, of which, FIG. 1 shows a schematic illustration of a riser system, and FIG. 2 shows a schematic illustration of a drilling system according to the first aspect of the invention including the riser system shown in FIG. 1.

Referring now to FIG. 1, there is shown a riser system 10 including a riser 12, the lower end of which is connected to well head (not shown), in this example via a blowout preventer (BOP) stack (not shown) mounted on the well head at the ocean floor or mudline. A drill string 13, as shown in FIG. 2, extends from well bore, through the well head, BOP stack and up the centre of the riser 12. An upper end of the riser 12 is connected to a rig floor 14 of a floating drilling rig which is provided with means for driving the drill string, typically a rotary table, or top drive (not shown). The riser assembly 10 is provided with a diverter 16 which provides an outlet for fluid from the riser 12 and which is connected to the upper end of the riser 12 via a conventional ball or flex joint 18. The ball or flex joint 18 allows for a degree of angular movement of the riser 12 with respect to the vertical whilst still maintaining a substantially fluid tight seal between the riser 12 and the diverter 16.

As in the known riser systems described above, the riser 12 is provided with a slip joint 20 which is located at around sea level 21 and comprises an outer tube section 20*a* which, in this example, forms part of a lowermost section of the riser 12 which extends down to the well head, and an inner tube section 20*b* which sits within the outer tube section 20*a* and which extends up to the rig floor 14. Seals 20*c* are provided between the outer 20*a* and inner 20*b* tube sections, and these substantially prevent leakage of fluid from the riser 12 whilst allowing the inner tube section 20*b* to slide relative to the outer tube section 20*a*. The length of the riser 12 may thus be varied to accommodate vertical movement of the rig floor as the sea level changes with the waves and tides.

Finally, a flow spool 22 is provided in the riser 12 between the slip joint 20 and the ball or flex joint 18. The flow spool 22 is provided with a side bore 22*a* which connects the riser annulus 12*a* to an annulus pressure control system 27 as shown in FIG. 2 which will be described in more detail below.

The lowermost section of the riser 12 is supported by tensioners 24 which extend from the rig floor 14 to the outer tube section 20*a* of the slip joint 20. The tensioners 24 are of conventional construction and each comprises a hydraulic cylinder 24*a* which is fixed relative to the rig floor 14 and a piston 24*b* which movable in the cylinder 24*a*. The piston 24*b* is connected to the outer tube section 20*a* of the slip joint 20 using a wire rope 24*c*, and fluid reservoirs are provided to supply fluid to the cylinder 24*a*, thus allowing the piston 24*b* to move within the cylinder 24*a*. The tensioners thus provide continuous support for the lowermost section of the riser 12, preventing the riser 12 from buckling as the rig floor moves up and down as the sea level rises and falls. Sometimes the tensioners are taken through a sheave (not shown) to allow the hydraulic pistons 24*b* to be better positioned.

All these elements are present in prior art riser systems. The present invention differs from these existing systems by the provision of a riser closure device 26 above the slip joint 20, in this example between the flex or ball joint 18 and flow spool 22. The riser closure device 26 is operable substantially to prevent fluid flow out of the top of the riser annulus and to retain fluid pressure in the riser annulus whilst permitting rotation of the drill string, and in this example comprises a rotating control device (RCD). The riser closure device 26 includes an elastomeric sealing element 26*a* which engages with the drill string and provides a substantially fluid tight seal between the riser 12 and the drill string even whilst the drill string 13 is rotating. The riser closure device 26 therefore acts to maintain fluid pressure in the riser 12 during drilling.

Whilst in this example, the riser closure device 26 is a conventional rotating control device, there are many possible configuration of suitable closure devices. The riser closure device 26 may comprise conventional BOP pipe rams with provision made for handling tool joints, or it may be a conventional annular BOP. The RCD could be passive or active, it may have a sealing element supported on bearings, or may be bearingless, and it may be a rotating or a non-rotating closure device.

Positioning the riser closure device 26 above the slip joint 20 is advantageous compared to the prior art arrangements as it simplifies the process of installing and maintaining the riser closure device 26. The lowermost section of the riser 12 and tensioners 24 may be installed prior to fitting the riser closure device 26, and need not be pulled if any component of the riser closure device 26 fails. The flow spool 22 can be made up to the inner tube section 20*b* of the slip joint 20 on the rig floor 14, and then the riser closure device 26 installed on top of the flow spool 22 and made up to the ball or flex joint 18. Finally, the flex or ball joint 18 can be made up to the diverter 16 and the whole assembly landed easily in a diverter housing. This arrangement has the advantage that the riser closure device 26 and flowspool 22 is not moving as in other installions such as the one described in U.S. Pat. No. 6,263,982 for example.

As mentioned above, the flow spool 22 is provided with a side bore 22*a* which is connected to an annulus return line 28 of a annulus pressure control system 27 (shown only in FIG. 2 for clarity) which is provided with a isolation valve 30, which can be operated to completely close the annulus return line 28. This isolation valve 30 is open during normal use, and is closed only if it is necessary to isolate the equipment in the annulus return line 28 from the fluid in the riser 12, for example to replace or repair this equipment. The annulus return line 28 extends from the isolation valve 30 to a mud reservoir 32 via a flow meter 34 and a gas actuated pressure control valve 36, operation of which is electronically controlled using an electronic control unit 38. Filters and/or shakers may be provided in the annulus return line 28 to remove solid matter such as drill cuttings from the mud.

The pressure control system 27 is further provided with a damper assembly 39 including a damper vessel (or chamber) 40 which is connected to the annulus return line 28 between the isolation valve 30 and the flow meter 34. The damper vessel 40 is divided into two compartments 40*a*, 40*b*, in this example by a diaphragm 42 (but it will be appreciated that a piston could equally be used), the first compartment 40*a* being in fluid communication with the annulus return line 28 and the second being filled with an inert gas, in this example nitrogen, from a pressurised gas reservoir 44. Flow of gas from the reservoir 44 to the second compartment 40*b* of the vessel 40 is controlled by a gas pressure regulator 46, operation of which is controlled electronically by the ECU 38. The damper assembly 39 may also be connected directly to the flowspool 22 before the valve 30 and to another outlet (not shown) similar to outlet 22*a*.

It will be appreciated that other means of dampening arrangement can be used instead of the damper assembly 39 described.

It will be appreciated that, without the flow spool 22, the riser 12 becomes a closed system by virtue of the presence of the riser closure device 26, and the lengthening and shortening of the slip joint 20 which occurs with the rise and fall of the sea level 21 causes the volume of the riser to increase and decrease rapidly. By positioning the riser closure device 26 above the slip joint 20, and without the provision of alternative means of relieving the pressure in the riser annulus 12*a*, this lengthening and shortening would give rise to pressure spikes (positive and negative) in the riser 12.

During managed pressure drilling or mud cap drilling operations, it is desirable to keep a substantially constant fluid pressure in the riser annulus 12*a* and the annulus of the well bore, and this is usually achieved by having a riser booster pump pumping mud into the bottom of the riser 12 near the sea floor, and using a hydraulically actuated automatic choke or pressure control valve to regulate and maintain the riser pressure at a substantially constant level. Such systems could not, however, respond quickly enough to keep the riser pressure constant during these rapid changes in riser volume.

In this invention, fluid pressure in the riser 12 is relieved, in a controlled manner, and therefore the riser pressure maintained at a substantially constant level, by the flow of fluid through the side bore 22*a* of the flow spool 22. During drilling, the pressure control valve 36 restricts the flow of drilling fluid (mud) along the annulus return line 28 to the reservoir 32, thus applying a back-pressure to the riser annulus 12*a*. The pressure in the return line 28 is monitored using a pressure sensor (not shown) which provides the ECU 38 with an input signal indicative of the pressure in the annulus return line 28. The ECU 38 then controls operation of the pressure control valve 36 to further restrict fluid flow along the annulus return line 28 if the pressure is lower than desired, or to ease the restriction on fluid flow along the annulus return line 28 if the pressure is higher than desired.

In this embodiment of the invention, the ECU 38 also controls operation of the pressure regulator 46 to maintain the pressure of gas in the second compartment 40*b* of the damper cylinder 40 at the same level as the desired annulus return line pressure. The pressure in the damper 40 is therefore actively controlled and varied in real time during drilling, and assists in maintaining a constant back-pressure on the riser annulus 12*a*, particularly during pressure spikes caused by movement of the slip joint 20.

It is conventional in subsea drilling systems to monitor the rate of flow of drilling fluid out of the riser annulus 12*a* during drilling and, by comparing the with the rate of flow of drilling fluid into the drill string, to use this information to detect events occurring down hole such as formation fluids entering the well bore, or drilling fluid penetrating the formation. The flow meter 34 located in the annulus return line 28 is provided for this purpose and sends a signal indicative of the fluid flow rate along the annulus return line 28 to a processor which in this example is the ECU 38. It will be appreciated, however, that in the system described above, the rate of flow of fluid out of the riser annulus will change with lengthening and shortening of the slip joint 20 as the volume of the riser 12 increases or decreases. This volume change could therefore mask variations in flow rate caused by such down hole events.

To address this, the system 10 is therefore provided with a displacement meter 48 which provides a signal indicative of the relative displacement of the outer 20*a* and inner 20*b* tube sections of the slip joint 20. In this example, the displacement meter 48 comprises a transmitter 48*a* which is mounted on riser 12 above the slip joint 20, i.e. is fixed relative to the inner tube section 20*b*, and a receiver 48*b* which is mounted on the outer tube section 20*a*. The transmitter transmits an infrared signal to the receiver 48*b*, and a processor is provided which determines the separation of the transmitter 48*a* and receiver 48*b* based on the time delay between the transmission and receipt of the signal. In this embodiment of the invention, the displacement meter 48 is connected to the same processor as the flow meter 34, which in this example is the ECU 38, and transmits a signal indicative of the length of the riser 12 at a given time to the ECU 38.

It should be appreciated that the signal need not be an infrared signal—the transmitter could transmit another form of signal, for example using an ultrasonic or laser beam. Moreover, the transmitter 48*a* may also be a receiver, in which case a reflector 48*b* would be mounted on the outer tube section 20*a* of the slip joint 20 to bounce the signal back to the transmitter/receiver 48*a*. Furthermore, the transmitter 48*a* may be mounted on the outer tube sections 20*a* and the receiver/reflector 48*b* may be mounted on the riser 12 above the inner tube section 20*b* of the slip joint 20. This displacement could equally be measured using any other appropriate means, such as a linear potentiometer, a multi-turn rotary potentiometer, a linear variable differential transformer, sonar or radar.

The internal cross-sectional area of the inner tube section 20*b* of the slip joint 20 and the external cross-sectional area of the drill string 13 are known, and the ECU 38 uses this and the signal from the displacement meter 48 to calculate the exact volume of the riser at any one time. The ECU 38 thus monitors the riser volume, and whenever it changes, calculates the change in flow rate in the annulus return line 28 that can be attributed to this change in volume. The flow rate determined by the flow meter 34 can then be corrected by the ECU 38 to give an accurate indication of the rate of flow out of the riser 12.

For example, if the sea level 21 drops momentarily, the inner tube section 20*b* of the slip joint 20 will slide into the outer tube section 20*a* thus reducing the separation of the transmitter 48*a* and receiver 48*b* of the displacement meter 48 by an amount $\delta D$ in a time period $\delta T$, and reducing the volume of the riser 12 by an amount $\delta V$ which is equal to the annular area between the riser internal diameter and the outer diameter of the drill string 13 multiplied by the displacement length. In other words $\delta V=\delta D\cdot(A_{SJ}-A_{DS})$, where $A_{SJ}$ is the internal cross-sectional area of the inner tube section 20*b* of the slip joint 20, and $A_{DS}$ is the external cross-sectional area of the drill string 13. This volume reduction will result in the displacement of an equal volume of fluid into the annulus return line 28 which will be detected by the flow meter 34 as a momentary increase in flow rate. The volume of fluid displaced out of the slip joint 20 can be deducted from the total flow rate detected by the flow meter 34 ($Q_{out}$) to give an actual flow rate out of the wellbore ($Q_{out.adj}$), according to the equation $$Q_{out\cdot adj} = Q_{out} + \left(\frac{\sigma V}{\sigma T}\right).$$

As there will be some additional fluctuation in volume in to the system caused by the expansion and contraction of the gas volume in the damper assembly 39, this can be measured by incorporating with pressure regulator 46 a mass flow meter which transmits to the ECU 38 a signal indicative of the mass flow rate of gas into and out of the second compartment 40*b* of the damper vessel 40. The damper assembly 39 is also provided with pressure and temperature sensors (not shown) which provide the ECU 38 with signals indicative of the pressure and temperature in the second compartment 40*b* of the damper vessel 40. The ECU 38 may thus be programmed to use this pressure and temperature information and the mass flow of gas into and out of the second compartment 40*b* to determine the volume of the second compartment 40*b*, and hence also the first compartment 40*a*, of the damper vessel at any time. This can be applied as a positive and negative correction factor to the flowrate measured by flowmeter 34.

Hydraulics modelling software may be used to convert the adjusted volumetric out flow rate ($Q_{out.adj}$) to a mass flow rate. To do this, it is necessary to account for the exact dimensions of the drill pipe, including tool joints, the position of the drill pipe and tool joints relative to the slip joint inner barrel in real time (constantly changing with time, drill string and rig heave movements), and the properties of the drilling fluid mud, including the temperature and compressibility. The temperatures and pressures will be taken from temperature and pressure transducers on the RPC system and MPD automated pressure control manifold, and the types of fluids/gasses in the system will be determined from the control and data acquisition system, using the mass fluid injected and returned flow rate meters. The compressibility factor of the various fluids present will be pre-programmed into the control system software (in this example in the ECU 38), and will be used by the ECU 38 to then calculate the pressure and volume change relationships. The movement of the slip joint will be determined by the displacement meter 48, and this along with the drill string dimensions and relative movement will determine the dimensions and position of the drill string within the slip joint, real time.

If the injected drilling fluid flow rate into the well is less than the produced fluid flow rate of drilling fluid mud out off the well bore, then there could be more fluid flow (gas or liquid) coming into the well bore from the formation. This could be interpreted as a kick or formation fluid inflow or influx into the well bore. If the injected drilling fluid mud rate into the well bore, via the drill pipe and rig pumps, is greater than the produced fluid flow rate out of the well bore, then some of the drilling fluid mud may be being injected into or lost to the formation.

In this system, therefore, the ECU 38 is programmed to compare the adjusted out flow rate with the rate of flow of drilling fluid into the drill string (the in flow rate), and if the adjusted out flow rate differs from the in flow rate by more than a first predetermined amount, raise and alarm signal to alert a operator of this. Moreover, if the adjusted out flow rate exceeds the in flow rate by more than a second pre-determined amount, the ECU 38 initiates a kick control procedure, and if the adjusted out flow rate is less than the in flow rate by more than a third pre-determined amount, the ECU 38 initiates an in flow control procedure.

During a kick control procedure, the drill bit may be picked up off the bottom of the well bore, and circulation continued while all drilling and injection parameters, rates and pressures, are maintained as constant as possible. Conditions may be monitored further, and if, following this, the event is indeed determined to be a kick then the bottom hole pressure (BHP) will be increased, preferably using the pressure control valve 36, to prevent any further formation fluid inflowing into the well bore. Alternatively, the BHP may be increased automatically and immediately the kick control procedure is initiated. Once the BHP has been increased enough to bring the well under control, and stop any further kick/inflow into the well bore, then one of 4 options will be taken. Again this is depending upon current well and formation conditions, and pre agreed and HAZOP'd operational and contingency procedures. These options are as follows:

a) continue to circulate and drill ahead while any minor, insignificant, spaced out, bubble flow, strung out formation fluid influx is circulated out through the annulus return line 28 (no BOP is closed and the well is circulated while closed in using the RCD), b) continue to circulate with the drill bit picked up off bottom while any minor, insignificant, spaced out bubble flow, strung out formation fluid influx is circulated out through the annulus return line 28 (again no BOP is closed, and the well is circulated while closed in using the RCD), c) a BOP is closed, and the well is circulated while closed in via a secondary flow line while any minor, insignificant, spaced out bubble flow, strung out formation fluid influx is circulated out through the annulus return line 28, d) managed pressure drilling operations are stopped, the well is shut in on a BOP, and the rig's conventional well control procedures are initiated.

Once the well is brought under control, and there is no formation fluid in the well bore or surface system, then the situation will be re-evaluated. If it is deemed operationally safe and effective to drill ahead in managed pressure drilling mode, then drilling will continue with a higher BHP and annulus pressure (WHP), or a revised higher mud weight will be used.

During an in flow control procedure the BHP will be decreased (for example, using the pressure control valve 36) to prevent any further drilling fluid being lost to or injected into the formation. Once the BHP has been decreased enough to bring the well under control and stop drilling fluid mud losses, then one of several options will be taken, again depending upon current well and formation conditions, and pre agreed and HAZOP'd operational and contingency procedures. These options are;

a) continue to circulate and drill ahead with a revised lower BHP and WHP, b) continue to circulate and drill ahead with a revised lower BHP and WHP, while lowering the drilling fluid mud density (weight), c) continue to circulate and not drill ahead with the bit picked up off bottom, with a revised lower BHP and WHP while the mud weight or density is lowered, d) one of the above options while Lost Circulation Material (LCM) is added to the drilling fluid mud.

If losses are very severe or total, then the well may be shut in using the rigs well control equipment and procedures, or the managed pressure drilling equipment may be used in mud cap drilling mode. The in flow control procedure may involve the use of a combination of any elements of (a) to (d).

Once the well is brought under control, and there is no further drilling fluid mud loss in the well bore or surface system, then the situation will be re-evaluated. If it is deemed operationally safe and effective to drill ahead in managed pressure drilling mode, then drilling will continue with a lower BHP and WHP, and/or a revised lower mud weight will be used.

During drilling, drill string heave compensators (i.e. springs between the drill string 13 and the rig floor 14) act to keep the drill string 13 "on-bottom", i.e. at the bottom of the well bore. The pressure control system 27 is also useful when drilling is not occurring, for example while tripping, or whilst connecting a new section of drill pipe to the drill string 13. During these procedures, however, a bottom hole assembly (BHA) mounted on the drill string 13 is off-bottom and the drill string heave compensators are locked. Any vertical movement of the rig as the sea level rises or falls, i.e. heave of the rig, will thus cause the BHA to move up and down in the well bore at the heave velocity of the rig. The clearances between the BHA, particularly its stabilizers, and the well bore can be tight and this can cause the BHA to act as a piston in the well bore. If the riser pressure control device 26 is in use, the BHA therefore exerts pressure pulsations on the bottom of the well bore. The phenomenon is known as surge and swab.

The slip joint volume will continue changing as described above irrespective of whether or not there is a drill pipe in the well bore, circulation is occurring, the drill pipe is being tripped in or out of the hole, or the well is being drilled or extended. Thus, the change in volume of the fluid in the bottom of the well bore resulting from this surge and swab can be calculated by multiplying the cross-sectional area of the BHA (A) by the displacement $\delta D$. The signal from the displacement meter 48 thus gives a real time indication of the heave of the rig, and therefore can be used to anticipate the vertical movement, i.e. surge and swab, of the drill string 13. The pressure control system 27 can then be used to induce an inverse pressure wave on the well bore to counteract the piston effect of the drill string assembly moving in and out of the well bore due to rig heave, and thus reduce the pressure fluctuations in the bottom of the well bore.

For example, if the sea level 21 drops and the rig heaves downwards, the fluid pressure at the bottom of the well bore would increase as the drill string 13 is pushed down into the well bore. However, the ECU 38 detects the heave of the rig by means of the signal from the displacement meter 48 which shows a decreased separation of the transmitter 48*a* and receiver 48*b* as the inner tube section 20*b* slides into the outer tube section 20*a* of the slip joint 20.

The ECU 38 is programmed to respond by operating the pressure control valve 36 to open to the required degree to decrease the restriction on fluid flow along the annulus return line 28 and therefore to decrease the back pressure on the riser annulus 12*a*. The decrease in back pressure balanced against the increase in pressure due to the piston effect of the BHA in the well bore minimizes any change in the bottom hole pressure. Similarly, if the rig heaves upwards due to a momentary rise in the sea level 21, the opposite occurs, and the pressure control valve 36 closes slightly to increase the back pressure applied to the riser annulus 12*a*.

This response can be further improved by operating the gas pressure regulator 46 to alter the amount of fluid taken into the damper vessel 40 at the same time as operating the pressure control valve 36. If this is done, the gas pressure regulator 46 is operated to release gas from the second compartment 40*b* of the damper vessel 40 during a downwards heave of the rig, and is operated so that pressurised gas flows into the second compartment 40*b* of the damper vessel 40 during an upwards heave of the rig.

The degree to which the pressure control valve 36 needs to open or close to counteract the surge or swab effects at the bottom of the well bore respectively is automatically calculated using the output from the displacement meter 48.

To calculate the pressure change from a change in the displacement of the slip joint 20, it will be necessary to use hydraulics modelling software to account for the temperature of the system, and the compressibility of the liquids and gasses present in the riser. The temperatures and pressures will be taken from temperature and pressure transducers at various positions in the system, and the types of fluids/gasses in the system determined from a control and data acquisition system, using the mass fluid injected and returned flow rate meters. The compressibility factor of the various fluids present will be pre-programmed into the control system software, and will be used, in this example by the ECU 36, to then calculate the pressure and volume change relationships.

To achieve accurate control of the bottom hole pressure in this way, it is necessary for there to be constant flow across the pressure control valve 36. As such, during drill string connections or trips, when ordinarily there may not be any fluid flow along the annulus return line 28, it is necessary to either operate a riser booster pump to pump drilling mud into the bottom of the riser 12, and/or to use a continuous circulation system such as that described in GB2427217 to pump mud into the drill string 13.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A drilling system including a drill string which extends from a floating drilling rig to a well bore, and a tubular riser which surrounds at least part of the portion of the drill string between the well bore and drilling rig, the riser having a telescopic joint between a first tubular portion and a second tubular portion of the riser, the first tubular portion extending down to a well head at the top of the well bore and the second tubular portion extending up towards the drilling rig, the telescopic joint comprising an inner tube part which is mounted within an outer tube part, the drilling system further including a riser closure device which is mounted in the second tubular portion of the riser and which is operable to provide a substantially fluid tight seal between the riser and the drill string whilst permitting the drill string to rotate relative to the riser, the riser having a main bore along which the drill string extends, and a side bore which extends from the main bore of the second portion of the riser between the telescopic joint and the riser closure device to the exterior of the riser, to a fluid flow line which extends from the side bore to a fluid reservoir, the fluid flow line being part of a flow control system, wherein the drilling system also includes a damper system which comprises a vessel which is divided into first and second substantially fluid tight chambers by means of a movable divider, the first chamber being connected to the fluid flow line and the second chamber being connected to a pressurized fluid reservoir, and a pressure regulator device which is operable to control the pressure of fluid in the second chamber.

2. A drilling system according to claim 1 wherein the riser closure device is a rotating control device.

3. A drilling system according to claim 1 wherein the flow control system further includes a flow control device which is provided in the fluid flow line and which is operable to restrict the flow of fluid along the fluid flow line to a variable degree.

4. A drilling system according to claim 3 wherein the flow control device is controlled using an electronic control unit.

5. A drilling system according to claim 4 wherein the drilling system further includes a pressure sensor which transmits an electrical signal indicative of the fluid pressure in the fluid flow line to the electronic control unit.

6. A drilling system according to claim 4 wherein the pressure regulator device is controlled using the electronic control unit.

7. A drilling system according to claim 1 wherein the drilling system includes a displacement meter which provides a displacement signal indicative of the displacement of the first portion of the riser relative to the second portion of the riser.

8. A drilling system according to claim 7 wherein the displacement meter is in communication with an electronic control unit so that it can transmit the displacement signal to the electronic control unit.

9. A drilling system according to claim 1 wherein the drilling system includes a flow meter which is located in the fluid flow line the flow meter providing a flow signal indicative of the rate of fluid flow along the fluid flow line.

10. A drilling system according to claim 9 wherein the flow meter is in communication with an electronic control unit so that it can transmit the flow signal to the electronic control unit.

11. A drilling system according to claim 1 wherein the telescopic joint includes a seal which extends between the inner tube part and the outer tube part of the telescopic joint so as to provide a substantially fluid tight seal between the inner tube part and the outer tube part whilst permitting the inner tube part and outer tube part to slide relative to one another.

12. A method of operating a drilling system according to claim 1 wherein the flow control system includes a flow control device which is provided in the fluid flow line and which is operable to restrict the flow of fluid along the fluid flow line to a variable degree, the method including the steps of controlling operation of both the flow control device and the pressure regulator to maintain a substantially constant fluid pressure in the fluid flow line.

13. A method of operating a drilling system according to claim 1 wherein, the flow control system includes a flow meter which is located in the fluid flow line, the flow meter providing a flow signal indicative of the rate of fluid flow along the fluid flow line, the well control system further including a displacement meter which provides a displacement signal indicative of the displacement of the first portion of the riser relative to the second portion of the riser, wherein the method includes the steps of using the displacement signal to calculate a change in volume of fluid in the riser over a particular period of time ($\delta V$), and using the flow signal and the calculated change in volume of fluid in the riser to produce an adjusted out flow rate, comparing the adjusted flow rate with the rate of flow of drilling fluid into the drill string (the in flow rate), and if the adjusted out flow rate differs from the in flow rate by more than a first predetermined amount raise an alarm signal to alert an operator of this, if the adjusted out flow rate exceeds the in flow rate by more than a second predetermined amount, operating the well control system to carry out a kick control procedure, and, if the adjusted out flow rate is less than the in flow rate by more than a third predetermined amount, operating the well control system to carry out an in flow control procedure.

14. A method according to claim 13 wherein δV is calculated using the formula:

$$\delta V = \delta D \cdot (A_{SJ} - A_{DS}),$$

where δD is the change in displacement of the first portion of the riser relative to the second over the period of time, $A_{SJ}$ is the internal cross-sectional area of the inner tube section of the telescopic joint, and $A_{DS}$ is the external cross-sectional area of the drill string.

15. A method according to claim 13 wherein the adjusted out flow rate (Qout.adj) is calculated using the formula:

$$Q_{out\text{-}adj} = Q_{out} + \left(\frac{\sigma V}{\sigma T}\right)$$

where Qout is the measured volumetric out flow rate.

16. A method of operating a drilling system including a drill string which extends from a floating drilling rig to a well bore, and a tubular riser which surrounds at least part of the portion of the drill string between the well bore and drilling rig, the riser having a telescopic joint between a first tubular portion and a second tubular portion of the riser, the first tubular portion extending down to a well head at the top of the well bore and the second tubular portion extending up towards the drilling rig, the telescopic joint comprising an inner tube part which is mounted within an outer tube part, the drilling system further including a riser closure device which is mounted in the second tubular portion of the riser and which is operable to provide a substantially fluid tight seal between the riser and the drill string whilst permitting the drill string to rotate relative to the riser, wherein the riser has a main bore along which the drill string extends, and a side bore which extends from the main bore of the second portion of the riser between the telescopic joint and the riser closure device to the exterior of the riser, the side bore being connected to a fluid flow line which extends from the side bore to a fluid reservoir, the fluid flow line being part of a flow control system which includes a flow control device which is provided in the fluid flow line and which is operable to restrict the flow of fluid along the fluid flow line to a variable degree, the well control system further including a displacement meter which provides a displacement signal indicative of the displacement of the first portion of the riser relative to the second portion of the riser, wherein the method includes the steps of using the displacement signal to calculate a change in volume of fluid in the riser over a particular period of time (δV), and operating the flow control device to decrease the fluid pressure in the fluid flow line if there is an decrease in the riser volume or to increase the fluid pressure in the fluid flow line if there is an increase in the riser volume.

* * * * *